US011536041B2

(12) United States Patent
Renz

(10) Patent No.: US 11,536,041 B2
(45) Date of Patent: Dec. 27, 2022

(54) CORNER SHUTTERING ELEMENT FOR SHUTTERING AND DESHUTTERING OF INNER CORNERS

(71) Applicant: PERI SE, Weissenhorn (DE)

(72) Inventor: Bernd Renz, Vohringen (DE)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 16/954,151

(22) PCT Filed: Dec. 17, 2018

(86) PCT No.: PCT/EP2018/085100

§ 371 (c)(1),
(2) Date: Jun. 15, 2020

(87) PCT Pub. No.: WO2019/115823

PCT Pub. Date: Jun. 20, 2019

(65) Prior Publication Data

US 2021/0164245 A1 Jun. 3, 2021

(30) Foreign Application Priority Data

Dec. 15, 2017 (DE) ..... 10 2017 222 868.7

(51) Int. Cl.

| | |
|---|---|
| ***E04G 11/08*** | (2006.01) |
| ***E04G 17/00*** | (2006.01) |
| ***B28B 7/30*** | (2006.01) |

(52) U.S. Cl.

CPC ..... *E04G 11/082* (2013.01); *B28B 7/30* (2013.01); *E04G 17/001* (2013.01)

(58) Field of Classification Search

CPC ... E04G 17/001; E04G 11/082; E04G 15/063; E04G 15/065; B28B 7/30

See application file for complete search history.

(56) References Cited

U.S. PATENT DOCUMENTS

| | | | | |
|---|---|---|---|---|
| 2,206,493 A * | 7/1940 | Whatling | ..... | E04G 17/001 249/194 |
| 3,244,395 A * | 4/1966 | Arrighini | ..... | E04G 17/001 249/194 |
| 4,447,035 A * | 5/1984 | Ivey | ..... | B28B 7/30 249/180 |
| 5,088,578 A | 2/1992 | Gates | | |
| 6,105,924 A * | 8/2000 | Carr | ..... | B28B 7/30 249/152 |

(Continued)

FOREIGN PATENT DOCUMENTS

| | | |
|---|---|---|
| CA | 2781450 | 6/2011 |
| DE | 870179 | 3/1953 |
| DE | 102009055690 | 5/2011 |

(Continued)

*Primary Examiner* — Michael Safavi
(74) *Attorney, Agent, or Firm* — Wei & Sleman LLP

(57) ABSTRACT

A corner shuttering element with two limbs arranged at an angle to each other, on the outer edge of which limbs, edge strips are arranged that can be retracted and extended by means of articulated levers, wherein the edge strips can each be aligned and fixed in their position by means of a plurality of locking elements arranged distributed over the height of the corner shuttering element, and wherein the locking elements are arranged on guides for pull-out webs of the edge strips.

12 Claims, 2 Drawing Sheets

(56) References Cited

U.S. PATENT DOCUMENTS

2019/0383044 A1* 12/2019 Johnson ..... E04G 17/001

FOREIGN PATENT DOCUMENTS

| | | | | |
|---|---|---|---|---|
| DE | 102013204999 | | 4/2014 | |
| EP | 0112113 | | 6/1984 | |
| FR | 1556651 | | 2/1969 | |
| FR | 2167578 | | 8/1973 | |
| FR | 2336531 | A1 * | 7/1977 | ..... E04G 15/065 |
| JP | S55159070 | | 12/1980 | |
| WO | 2011063922 | | 6/2011 | |

* cited by examiner

CORNER SHUTTERING ELEMENT FOR SHUTTERING AND DESHUTTERING OF INNER CORNERS

FIELD OF THE INVENTION

The invention relates to a corner shuttering element for shuttering and deshuttering inner corners, in particular of shafts.

BACKGROUND OF THE INVENTION

Corner shuttering elements of this kind comprising two limbs which are arranged so as to be at an angle relative to one another and which can each be connected to one further shuttering element, respectively, and on the limbs of which retractable and extendable edge strips are arranged in each case, on the outside edge, it being possible for the edge strips, together with the further shuttering elements, to be retracted and extended by means of a plurality of articulated levers arranged on a common tension rod, and it being possible for the edge strips to in each case be oriented and fixed in position, with respect to the outside of the limb, by means of a plurality of bolt elements that are arranged so as to be distributed over the height of the corner shuttering element, are already known from the prior art. They are used in particular in shaft shuttering for elevator shafts or the like. Using four corner shuttering elements of this kind, and further shuttering elements arranged therebetween, makes it possible for a complete inner shuttering body to be produced, in which, following concreting of the shaft or shaft portion, all the shuttering elements can be released from the concreted wall of the shaft and be removed upwards, out of the shaft, as a complete shuttering body, by means of pulling on the tension rods of the corner shuttering elements. A shaft shuttering device of this kind is explained for example in DE 10 2009 055 690 A1. The movable edge strips make it possible for the widths of the limbs of the corner shuttering element to be reduced for the purpose of deshuttering. In this case, the adjoining shuttering elements are also retracted into the corner shuttering element, together with the edge strips. If this retraction is performed by pulling on the tension rods of all four corner shuttering elements, then the overall inner shuttering body of the shaft shuttering contracts to a smaller overall volume and can be drawn out of the concreted shaft by means of a crane hook.

In order for said retraction of the edge strips and of the adjoining shuttering elements to be possible, the outer edge portions of the limbs of the corner shuttering element generally consist of relatively thin metal profiles which are fastened to a limb base body that is reinforced by ribs. There is therefore the risk of said edge portions being pushed inwards by the pressure exerted by the concrete, when the concrete is poured in, which is noticeable in the finished concreted shaft by an indentation in the concrete surface. Therefore, in order to prevent this problem, bolt elements are used which press the edge strips against the edge portion of the limb and fix said strips in position. The edge portion of limb is therefore reinforced by the edge strip, in order to be able to withstand a higher concrete pressure.

The bolt elements comprise a displaceable rod-like angled bolt body, the rod-like portion of the bolt body being positioned against the edge strip from the inside, and being fixed in a guide of the bolt element, by means of a threaded spindle, in the direction of the outside of the limb. In this case, the guide of the bolt body is fastened to reinforcing ribs provided on the limb base body. Therefore, the bolt bodies hitherto are relatively complex in structure, and are also not particularly simple to assemble, since the bolt bodies have to be placed precisely on the edge strip. A further crucial disadvantage is that the bolt elements can be arranged on the limbs of the corner shuttering element only in the region of reinforcing ribs. However, in the lower region of the corner shuttering element that is particularly loaded by the concrete pressure, no reinforcing ribs are provided, but rather articulated levers for retraction and extension of the edge strips. The previous bolt elements for orienting the edge strips therefore cannot be optimally positioned.

SUMMARY OF THE INVENTION

The object of the present invention is that of developing a corner shuttering element such that an improved orientation of the edge strips of the limbs of the corner shuttering element is achieved compared with known corner shuttering elements.

The object is achieved by a corner shuttering element.

The corner shuttering element according to the invention for shuttering and deshuttering inner corners, in particular of shafts, comprises two limbs that are arranged so as to be at an angle relative to one another and which can in each case be connected to a further shuttering element. In each case, retractable and extendable edge strips are arranged on the limbs, it being possible for the edge strips, together with the further shuttering elements, to be retracted and extended by means of a plurality of articulated levers arranged on a common tension rod, and it being possible for the edge strips to in each case be oriented and fixed in position, with respect to the outside of the limb, by means of a plurality of bolt elements that is arranged so as to be distributed over the height of the corner shuttering element. According to the invention, the corner shuttering element is characterized in that the bolt elements are arranged on guides for extraction struts of the edge strips.

In the case of the corner shuttering element according to the invention, the bolt elements are no longer fastened to ribs, but rather to guides for extraction struts of the edge strips. The articulated levers for retracting and extending the edge strips also engage on said extraction struts. Since extraction struts of this kind are in any case arranged on the top and bottom end of the edge strips, the bolt elements can now also be fastened very tightly to the bottom end of the edge strips, and thus ensure reinforcement and stabilization of the edge portion at the point where the highest concrete pressure is exerted on the edge portion of the limbs of the corner shuttering element.

In a preferred embodiment of the corner shuttering element, the outer edge of the limb is in each case formed by an angle section, the first profile limb of which is fixed to a base body of the limb, and the second profile limb of which, together with the outside of the base body, forms a shuttering skin of the limb. The edge strip can be positioned from the inside, against the profile limbs of the angle section that form the shuttering skin, by means of the bolt elements. Thus, the free profile limb of the angle section is supported by the edge strip at the outermost edge thereof. In this case, it is possible to orient the edge strips by means of the bolt elements such that they bring the profile limbs of the angle section, which also form the shuttering skin, into an orientation that is flush with the outside of the base body, and fix them in said position. The flush course of the shuttering skin of the entire corner shuttering element with the adjacent shuttering elements is maintained, even during concreting, as a result of the edge strip that is positioned against the free profile limb by means of the bolt elements.

Further advantages result if the bolt elements in each case comprise an adjustable clamping jaw which engages on the extraction strut of the edge strip. In this way, it is possible to omit providing separate bolt bodies in the case of the bolt element. The clamping jaw presses directly on the extraction strut and thereby presses the edge strip against the shuttering skin of the corner shuttering element.

The clamping jaw may be manually adjustable for this purpose. This allows for precise orientation of the edge strip over the entire length thereof, by means of different bolt elements. In this case, it is also possible to press the clamping jaw against the extraction strut of the edge strip more strongly in the bottom region of the corner shuttering element, in order to compensate the higher concrete pressure, to be expected there, compared with the concrete pressure in the top region of the corner shuttering element.

There are various options for the actual design of the bolt elements. In a preferred embodiment, the bolt elements are in each case formed so as to be substantially U-shaped, and the clamping jaw is mounted in the base of the U and is linearly displaceable between the limbs of the U. The bolt elements are thus stable components that are easy to produce, and are furthermore simple to mount. In this case, the bolt elements may be fastened to the guide of the extraction strut by means of a screw or a bolt, the screw or the bolt being guided through a slot in the extraction strut in a manner having axial clearance. As a result of the slot, the extraction struts, and thus the edge strips, can be retracted and extended without being impeded by the bolt elements. The lateral clearance between the screw or bolt and the slot allows for a displacement of the extraction strut, and thus of the edge strip, in the direction of the outside of the limb, by means of the clamping jaw, in order to be able to optimally orient the edge strip.

In this case it is advantageous, even in the case of very short corner shuttering elements, for one bolt element to be arranged, in each case, at least on the lowest guide for an extraction strut of the edge strip. This is where the risk of deformation of the edge portions of the limbs of the corner shuttering element by the concrete pressure is greatest. However, the bolt elements can preferably be arranged so as to be uniformly distributed over the height of the corner shuttering element. Typical heights for the corner shuttering element are 1.20 m, 2.70 m, 3.00 m, 3.30 m or 3.60 m. Whereas, in the case of the shorter corner shuttering elements, four bolt elements per limb are sufficient, six bolt elements per limb should be provided in the case of heights of above 3.30 m.

Further advantages and properties of the invention will be explained in greater detail in the following, on the basis of an embodiment and with reference to the drawings.

BRIEF DESCRIPTION OF THE DRAWINGS

In detail.

DETAILED DESCRIPTION

Figure 1:
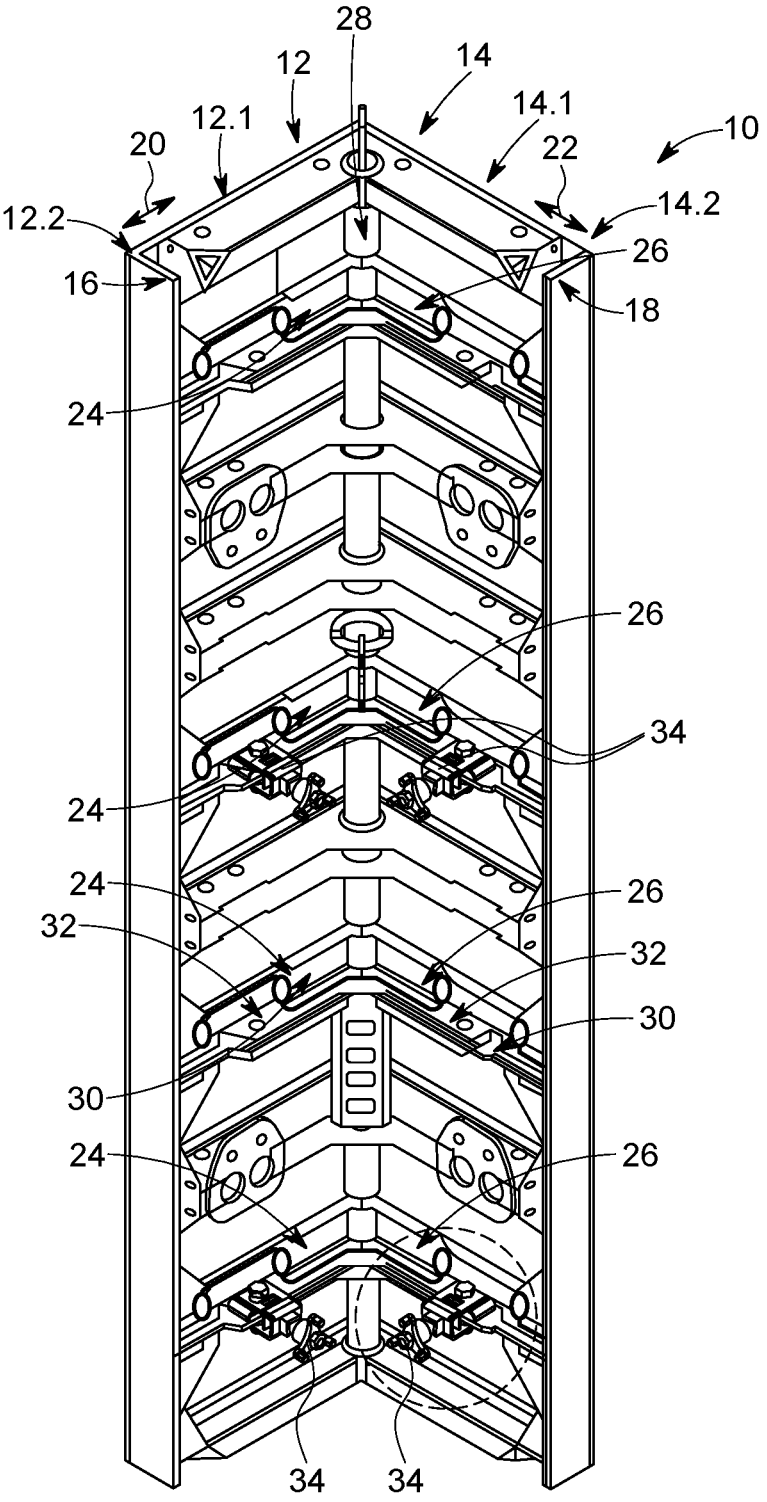
FIG. 1 is a perspective inside view of a corner shuttering element according to the invention.

FIG. 1 shows a corner shuttering element 10 according to the invention for inner shuttering (not otherwise shown in greater detail) for a shaft. The corner shuttering element 10 comprises two limbs 12, 14 that are arranged so as to be at right-angles to one another, the outsides 12.1, F forming a shuttering skin of the corner shuttering element 10. The limbs 12, 14 each comprise outside edge portions 12.2, 14.2 which are in each case formed of a metal profile and fastened to a limb base body. Within said edge portions 12.2, 14.2, in each case edge strips 16, 18 can be retracted and extended in the arrow directions 20, 22. Articulated levers 24, 26 are provided for this movement of the edge strips 16, 18, which levers can be actuated by pulling on a tension rod 28. For this purpose, the edge strips 16, 18 comprise extraction struts 30 which are guided in guides 32 on the inside of the limbs 12, 14. Bolt elements 34 are fastened to some of said guides 32, which bolt elements are used to orient the edge strips 16, 18 in the direction of the shuttering skin 12.1, 14.1, as shown in particular in FIG. 2.

Figure 2:
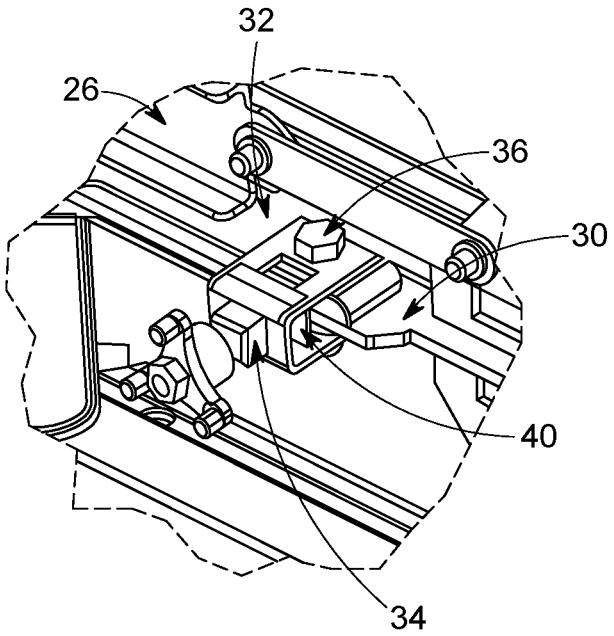
FIG. 2 is an enlarged detailed view of the corner shuttering element from FIG. 1.

FIG. 2 is an enlarged view of the detail II from FIG. 1. The fastening of the bolt element 34 to the guide 32 of the extraction strut 30 by means of a screw 36 can be seen. The screw 36 is guided through a slot (not shown) in the extraction strut 30 in a manner having lateral clearance, such that the movement of the edge strip 18 in the arrow direction 22 is not impeded by the bolt element 34. The extraction struts 30 can therefore move freely along the guides 32, said movements of the edge strips 16, 18 being triggered by the articulated levers 26.

Figure 3:
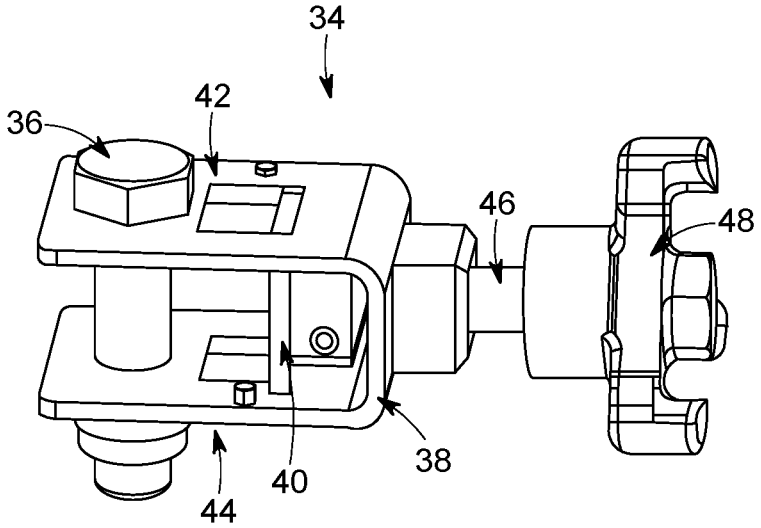
FIG. 3 is an individual view of a bolt element of the corner shuttering element from FIG. 1.

As is also clear in particular from FIG. 3, the bolt element 34 is substantially U-shaped, a clamping jaw 40 being mounted in a base 38 of the U so as to be displaceable between limbs 42, 44 of the U. In order to adjust the clamping jaw 40, a threaded spindle 46 is provided, on which spindle an adjusting wheel 48 for manual adjustment of the clamping jaw 40 is arranged.

As shown in FIG. 2, the clamping jaw 40 presses laterally on the extraction strut 30 and thus moves said strut, as well as the edge strip 18 (not shown in FIG. 2) fastened thereto in the direction of the shuttering skin 14.1. Since the edge strip 18 rests against the edge portion 14.2 of the limb 14 from the inside, said edge portion 14.2 can be oriented and stabilized using the bolt elements 34, such that it can withstand the concrete pressure, arising during concreting, in the same way as the base bodies of the limbs 12, 14. In this case, in particular the bolt elements 34 in the bottom region of the corner shuttering element 10 are of particular significance, since the concrete pressure acting on the limbs 12, 14 is greatest in said region.

In FIG. 1, the edge strips 16 and 18 are extended, i.e. the corner shuttering element 10 and further shuttering elements (not shown here) that adjoin the edge strips 16, 18 together form an inner shuttering, for example for a shaft or building corner. In this case, four corner shuttering elements 10 of this kind can be interconnected, by means of at least one further shuttering element in each case, to form a complete inner shaft shuttering. For the purpose of deshuttering, the edge strips 16, 18 and the shuttering element adjoining said strips can be pulled inwards by means of pulling on the tension rod 28, using the articulated levers 24, 26. If this is carried out on all four corner shuttering elements 10 of the inner shaft shuttering, then all the shuttering elements can be released from the concreted wall and the inner shaft shuttering, as a single shuttering body, can be reduced in volume such that the entire shuttering body can be withdrawn upwards, out of the shaft.

The corner shuttering elements 10 can be produced in different heights. Conventional heights are 1.20 m, 2.70 m, 3.00 m, 3.20 m and 3.60 m. The design according to the invention ensures that a smooth concrete surface results on the inside of the shaft, even in the case of high corner shuttering elements 10.

The invention claimed is:

1. A corner shuttering element for shuttering and deshuttering of inner corners, comprising two limbs which are arranged so as to be at an angle relative to one another and which can each be connected to one further shuttering element, respectively, and retractable and extendable edge strips are arranged on the outside edge of each of the two limbs, the edge strips, together with the further shuttering elements, configured to be retracted and extended by a plurality of articulated levers arranged on a common tension rod, and each edge strip is configured to be oriented and fixed in position, with respect to the outside of the limb, by a plurality of bolt elements that are arranged so as to be distributed over the height of the corner shuttering element, wherein the bolt elements are arranged on guides for extraction struts of the edge strips.

2. The corner shuttering element according to claim 1, wherein each outer edge of the limbs is formed by an angle section, one profile limb of which is fastened to a base body of the limb, and the second profile limb of which, together with the outside of the base body, forms a shuttering skin of the limb, and in that the edge strip can be placed, from the inside, against the profile limb of the angle section that forms the shuttering skin, by means of the bolt elements.

3. The corner shuttering element according to claim 2, wherein the edge strips can be oriented by means of the bolt elements such that they bring the profile limbs of the angle section, which also form the shuttering skin, into an orientation that is flush with the outside of the base body, and fix them in said flush orientation of the profile limbs.

4. The corner shuttering element according to claim 1, wherein each of the bolt elements comprise one adjustable clamping jaw, respectively, which engages on the extraction strut.

5. The corner shuttering element according to claim 4, wherein each of the bolt elements are formed so as to be substantially U-shaped, and the clamping jaw is mounted in the base of the U and is linearly displaceable between the limbs of the U.

6. The corner shuttering element according to either claim 4 or claim 5, wherein the clamping jaw is manually adjustable.

7. The corner shuttering element according to claim 1, wherein each of the bolt elements are fastened to the guide of the extraction strut by means of a screw or a bolt, the screw or the bolt being guided through a slot in the extraction strut in a manner having axial clearance.

8. The corner shuttering element according to claim 1, wherein one bolt element is arranged at least on the bottom guide of each limb for a respective extraction strut of the edge strip.

9. The corner shuttering element according to claim 1, wherein the bolt elements are arranged so as to be uniformly distributed over the height of the corner shuttering element.

10. The corner shuttering element according to claim 1, wherein the corner shuttering element is 1.20 m, 2.70 m, 3.00 m, 3.30 m or 3.60 m high.

11. A corner shuttering element, comprising:

at least two limbs arranged at an angle relative to one another, each of the at least two limbs configured to be connected to one further shuttering element, respectively, wherein a retractable and extendable edge strip is arranged on an outside edge of each of the two limbs such that the edge strips, together with the at least one further shuttering element, are configured to be retracted and extended by a plurality of articulated levers arranged on a common tension rod, wherein each edge strip is configured to be oriented and fixed in position, with respect to an outside of the limb, by a plurality of bolt elements arranged so as to be distributed over a height of the corner shuttering element, wherein the plurality of bolt elements are arranged on guides for extraction struts of the edge strips.

12. A corner shuttering element, comprising:

a first limb configured to be connected to a first further shuttering element, wherein a first retractable and extendable edge strip is arranged on a first outside edge of the first limb; and a second limb arranged at an angle relative to the first limb, the second limb being configured to be connected to a second further shuttering element, wherein a second retractable and extendable edge strip is arranged on a second outside edge of the second limb such that the first retractable and extendable edge strip, the first further shuttering element, the second retractable and extendable edge strip, and the second further shuttering element are configured to be retracted and extended by a plurality of articulated levers arranged on a common tension rod, wherein the first retractable and extendable edge strip is configured to be oriented and fixed in position, with respect to an outside of the first limb, by a first plurality of bolt elements arranged so as to be distributed over a height of the corner shuttering element, wherein the first plurality of bolt elements are arranged on first guides for first extraction struts of the first edge strip, wherein the second retractable and extendable edge strip is configured to be oriented and fixed in position, with respect to an outside of the second limb, by a second plurality of bolt elements arranged so as to be distributed over a height of the corner shuttering element, wherein the second plurality of bolt elements are arranged on second guides for second extraction struts of the second edge strip.

* * * * *